US009561398B2

(12) United States Patent
Chen

(10) Patent No.: US 9,561,398 B2
(45) Date of Patent: Feb. 7, 2017

(54) INCLINE ANGLE ADJUSTABLE STAIR CLIMBING MACHINE

(71) Applicant: HEALTHSTREAM TAIWAN INC., Taoyuan (TW)

(72) Inventor: Chun-Ting Chen, Taoyuan (TW)

(73) Assignee: HEALTHSTREAM TAIWAN INC., Taoyuan (TW)

( * ) Notice: Subject to any disclaimer, the term of this patent is extended or adjusted under 35 U.S.C. 154(b) by 0 days.

(21) Appl. No.: 14/791,923

(22) Filed: Jul. 6, 2015

(65) Prior Publication Data

US 2016/0263432 A1 Sep. 15, 2016

(30) Foreign Application Priority Data

Mar. 13, 2015 (TW) ..... 104108022 A

(51) Int. Cl.
*A63B 22/04* (2006.01)

(52) U.S. Cl.
CPC ..... *A63B 22/04* (2013.01)

(58) Field of Classification Search
CPC ..... A63B 22/0015; A63B 22/0017; A63B 22/0023; A63B 22/0046; A63B 22/04; A63B 2022/0028; A63B 2022/003; A63B 23/04; A63B 23/0405; A63B 23/0482; A63B 23/0494; A63B 2208/02; A63B 2208/0204; A63B 2208/0209; A63B 2225/09; A63B 2225/093

See application file for complete search history.

(56) References Cited

U.S. PATENT DOCUMENTS 3,497,215 A * 2/1970 Harrison ..... A63B 21/154 482/53
3,592,466 A * 7/1971 Parsons ..... A63B 22/0023 482/1
3,626,438 A * 12/1971 Cornell ..... E04F 11/0255 52/183
4,687,195 A * 8/1987 Potts ..... A63B 21/015 482/52
5,328,420 A * 7/1994 Allen ..... A63B 22/04 482/37
5,352,166 A * 10/1994 Chang ..... A63B 69/0048 482/37
5,556,352 A * 9/1996 Chang ..... A63B 22/04 482/51
5,769,759 A * 6/1998 Alter ..... A63B 22/04 482/37
6,348,024 B1 * 2/2002 Hwang ..... A63B 22/0235 482/35

(Continued)

*Primary Examiner* — Stephen Crow
*Assistant Examiner* — Gary D Urbiel Goldner
(74) *Attorney, Agent, or Firm* — Muncy, Geissler, Olds & Lowe, P.C.

(57) ABSTRACT

An incline angle adjustable stair climbing machine includes a base frame, a tilting seat pivotally mounted at the base frame, a tilting seat adjuster for adjusting an incline angle of the tilting seat relative to the base frame, a staircase mounted at the tilting seat and including a plurality of tread boards biasable relative to the tilting seat, and a tread board adjuster mounted at the tilting seat for adjusting a biasing angle of the tilting seat to maintain the plurality of tread boards constantly horizontal for enabling a user to conduct stair-climbing exercises at different climb gradients while maintaining good posture.

8 Claims, 9 Drawing Sheets

(56) References Cited

U.S. PATENT DOCUMENTS

| | | | | |
|---|---|---|---|---|
| 6,474,024 | B1 * | 11/2002 | Macintyre | E04H 3/126 52/10 |
| 7,101,317 | B2 * | 9/2006 | Kuo | A63B 22/0023 482/35 |
| 9,017,224 | B1 * | 4/2015 | Singley | A63B 22/001 482/52 |
| 9,278,036 | B2 * | 3/2016 | Lee | A61G 5/061 |
| 9,381,397 | B2 * | 7/2016 | Orgal | A63B 23/0405 |
| 2008/0163571 | A1 * | 7/2008 | Kohler | B63B 27/14 52/183 |
| 2009/0209394 | A1 * | 8/2009 | Kwon | A63B 22/001 482/52 |
| 2009/0266969 | A1 * | 10/2009 | Costello | B28B 7/225 249/14 |
| 2009/0291810 | A1 * | 11/2009 | Kwon | A63B 22/001 482/52 |
| 2010/0293875 | A1 * | 11/2010 | Preston | E04F 11/022 52/183 |
| 2014/0202777 | A1 * | 7/2014 | Lee | A61G 5/066 180/9.32 |
| 2014/0228177 | A1 * | 8/2014 | Brewer | A63B 69/0048 482/37 |
| 2015/0165263 | A1 * | 6/2015 | Golen, Jr. | A63B 22/04 482/7 |
| 2015/0190670 | A1 * | 7/2015 | Strommen | A63B 22/04 482/52 |
| 2015/0190671 | A1 * | 7/2015 | Golen, Jr. | A63B 22/04 482/52 |

* cited by examiner

INCLINE ANGLE ADJUSTABLE STAIR CLIMBING MACHINE

BACKGROUND OF THE INVENTION

1. Field of the Invention

The present invention relates to fitness machine technology, and more particularly to an incline angle adjustable stair climbing machine.

2. Description of the Related Art

Because modern people are busy with work and do not have much time to engage in outdoor sports and outdoor sport activities are susceptible to weather, in order not to be constrained by time and weather, office workers who love to exercise usually will prepare a fitness machine at home for use any time when desired to achieve the effect of fitness. In order to meet the needs of different users, various fitness machines with different functions are commercially available for selection, such as treadmills, steppers, elliptical machines, or stair climbing machines. In a stair climbing machine, the circulation of tread boards enables the user to simulate a stair climbing exercise, strengthening the muscle strength and improving the functions of the heart and the lungs. However, the climb gradient of regular stair climbing machines it normally fixed, not adjustable according to user training needs. Therefore, the fitness effect the user can get from a conventional stair climbing machine is very limited.

SUMMARY OF THE INVENTION

The present invention has been accomplished under the circumstances in view. It is the main object of the present invention to provide a stair climbing machine, which allows adjustment of the incline angle to change the climb gradient, satisfying different training needs.

To achieve this and other objects of the present invention, an incline angle adjustable stair climbing machine comprises a base frame, a tilting seat, a tilting seat adjuster, a staircase, and a tread board adjuster. The tilting seat has a rear end thereof pivotally connected to a rear end of the base frame. The tilting seat adjuster is mounted between an opposing front end of the base frame and an opposing front end of the tilting seat, and adapted for adjusting the incline angle of the tilting seat. The staircase is mounted at the tilting seat, comprising a plurality of tread boards biasable relative to the tilting seat. The tread board adjuster is mounted at the tilting seat and connected with the tread boards of the staircase, and adapted for adjusting the angle of each tread board relative to the tilting seat, maintaining each tread board constantly in horizontal. Thus, when using the incline angle adjustable stair climbing machine, operate the tilting seat adjuster to adjust the incline angle of the tilting seat and then operate the tread board adjuster to adjust the angle of each tread board, enabling the user to conduct stair-climbing exercises at different climb gradients accurately and comfortably.

Preferably, the incline angle adjustable stair climbing machine further comprises a handrail and a handrail adjuster. The handrail has a rear end thereof pivotally connected to the rear end of the base frame. The handrail adjuster is mounted between the front end of the tilting seat and an opposing front end of the handrail, and adapted to adjust the incline angle of the handrail, enabling the handrail to be synchronously adjusted with the tilting seat.

Preferably, the staircase further comprises a tread board adjustment frame. The tread board adjustment frame is vertically movably mounted at the tilting seat and connected with each tread board. The tread board adjuster is mounted between the tilting seat and the tread board adjustment frame for enabling the tread board adjuster to adjust the angle of each tread board via the tread board adjustment frame.

Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
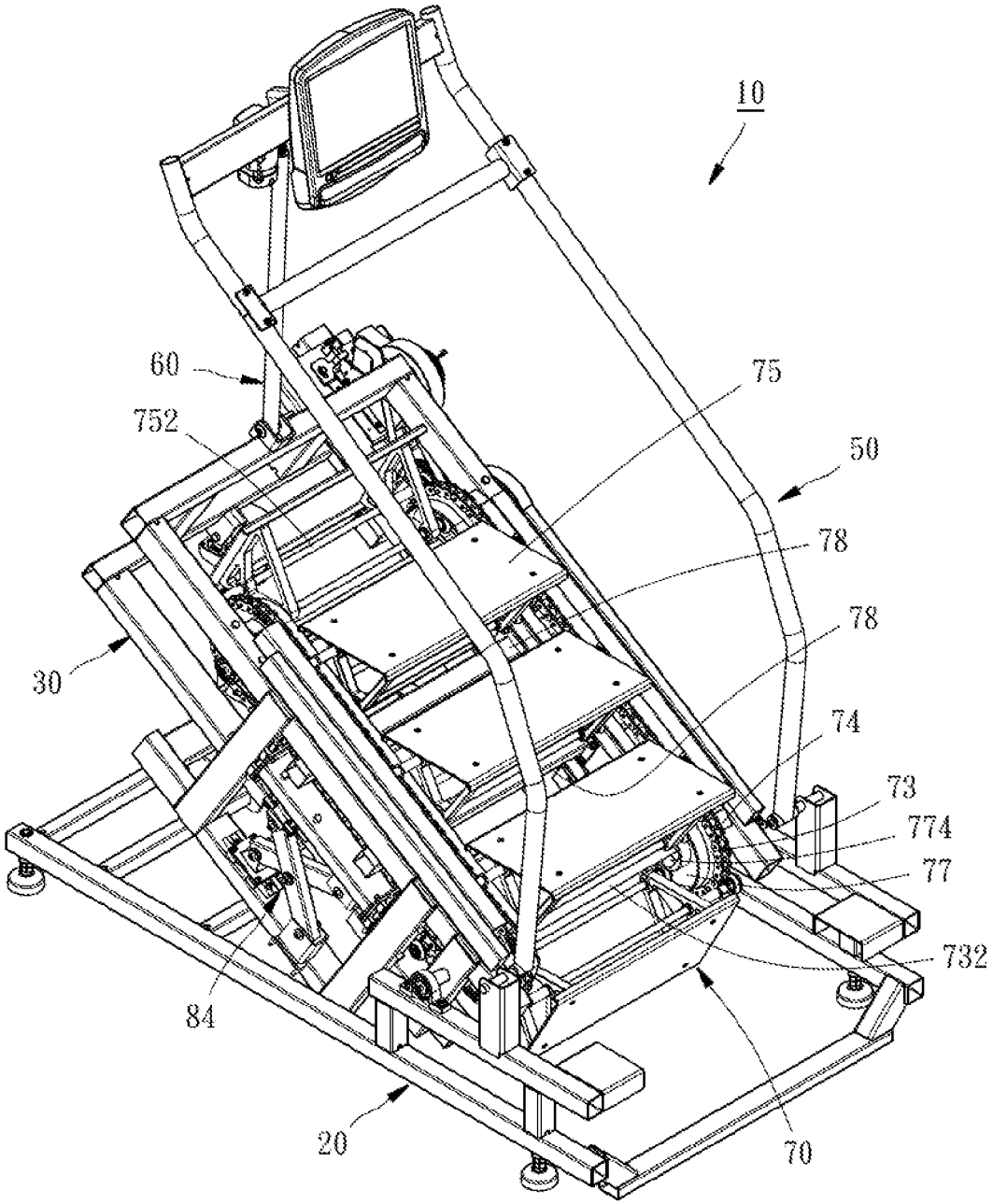
FIG. 1 is an oblique top elevational view of an incline angle adjustable stair climbing machine in accordance with the present invention.
Figure 2:
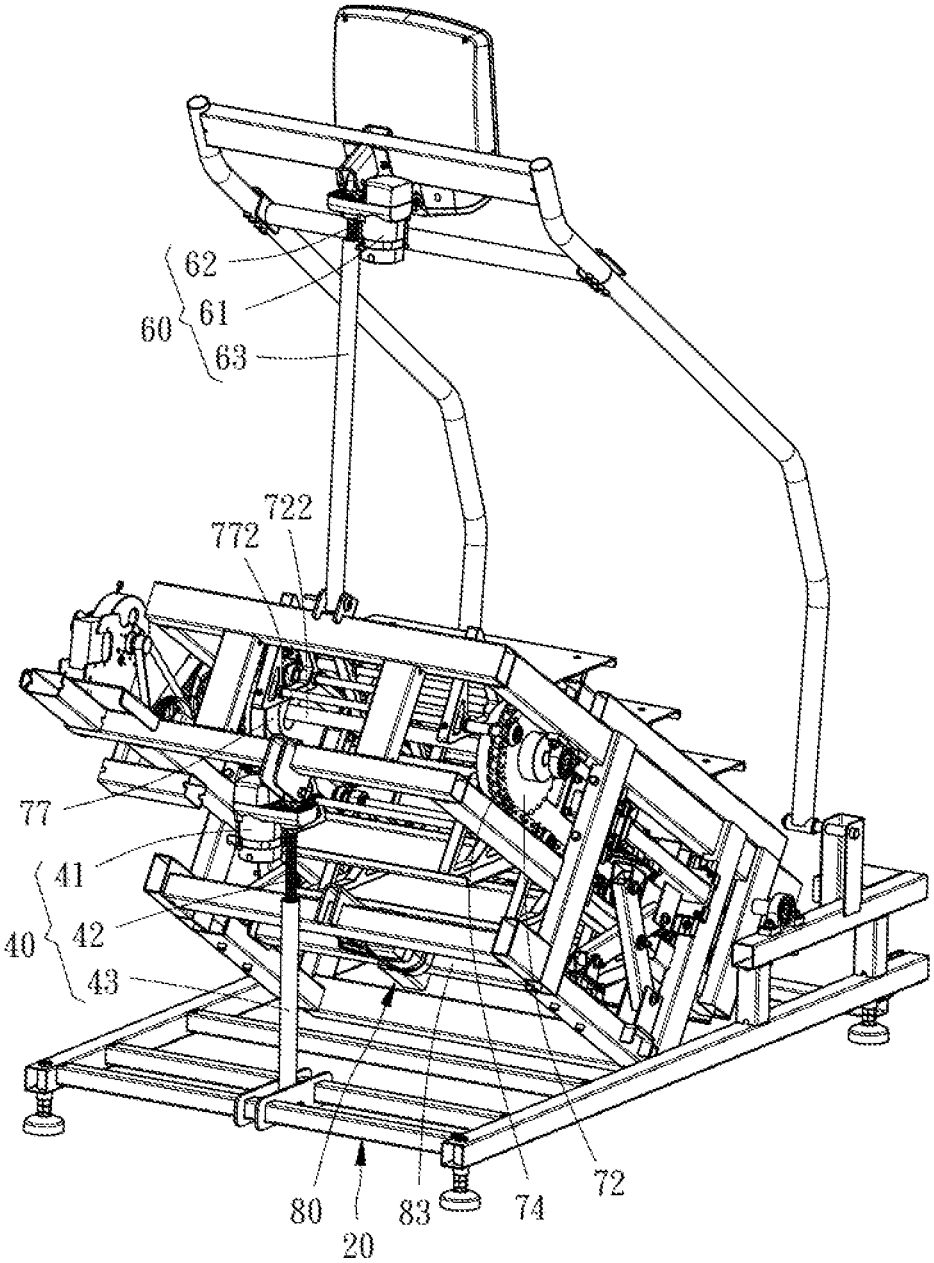
FIG. 2 corresponds to FIG. 1 when viewed from another angle.
Figure 4:
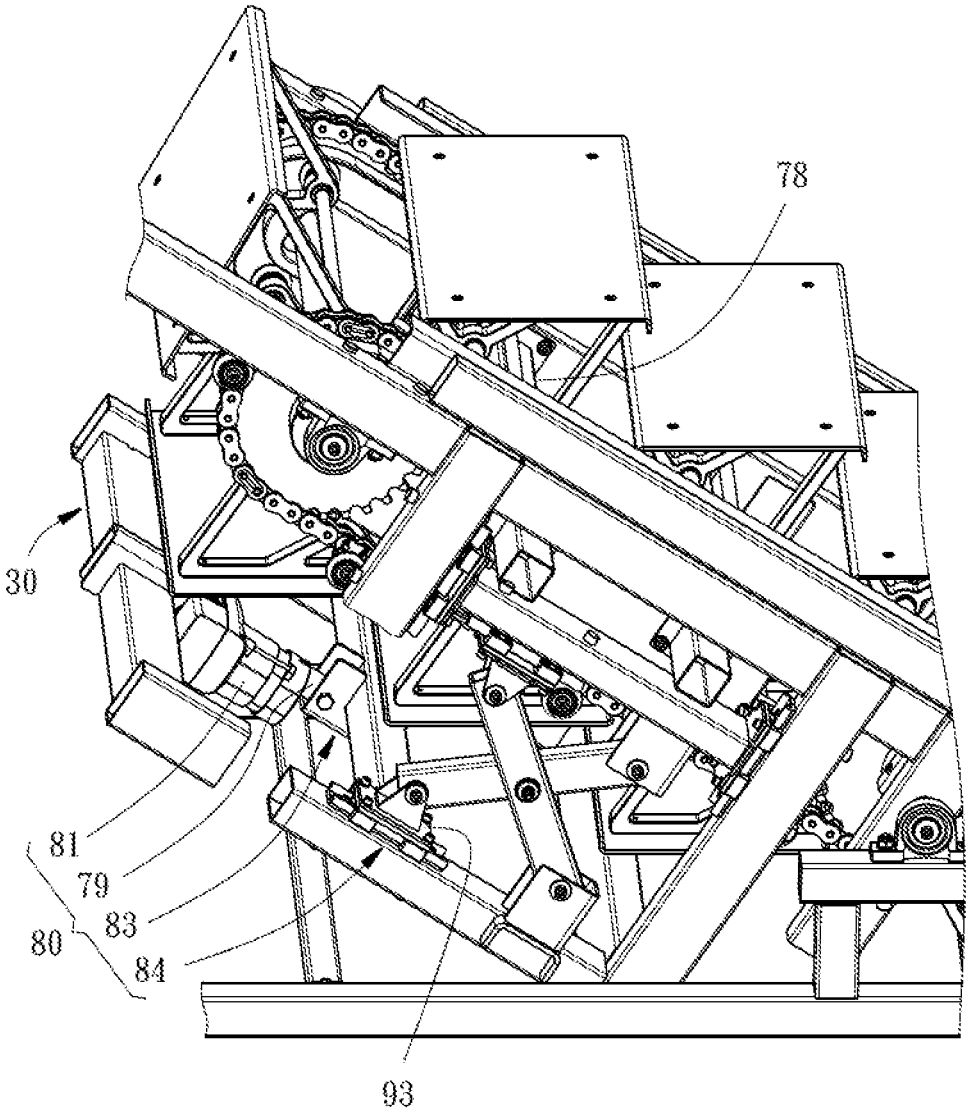
FIG. 4 is an elevational view of a part of the present invention, illustrating the structure of the tread board adjuster.
Figure 5:
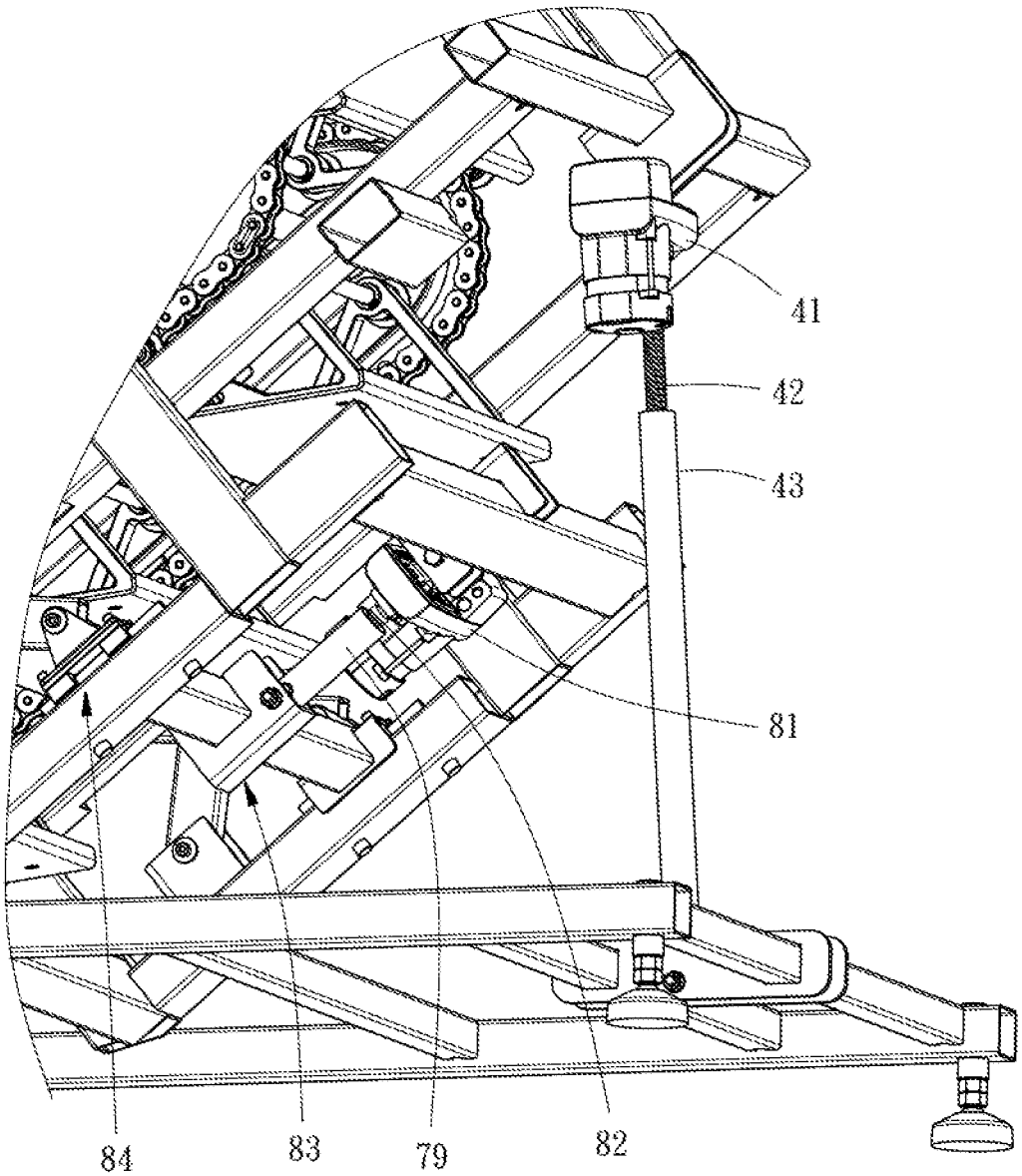
FIG. 5 is a partial elevational view of the present invention, illustrating an operating status of the tread board adjuster.

Referring to FIGS. 1, 2 and 4, a stair climbing machine 10 in accordance with the present invention is shown. The stair climbing machine 10 comprises a base frame 20, a tilting seat 30, a tilting seat adjuster 40, a handrail 50, a handrail adjuster 60, a staircase 70, and a tread board adjuster 80.

The base frame 20 is adapted to be positioned on a floor to provide a supporting effect.

The tilting seat 30 has a rear end thereof pivotally connected to a rear end of the base frame 20.

The tilting seat adjuster 40 comprises a first motor 41, a first screw rod 42, and a first sleeve 43. The first motor 41 is pivotally mounted at an opposing front end of the tilting seat 30. The first screw rod 42 has a top end thereof connected to the first motor 41. The first sleeve 43 is threaded onto the first screw rod 42 with a bottom end thereof affixed to the base frame 20. Thus, when the first motor 41 is started to rotate the first screw rod 42 clockwise or counter-clockwise, the first screw rod 42 causes the first motor 41 to move axially upward or downward along the first screw rod 42, thereby turning the tilting seat 30 upward or downward relative to the base frame 20.

The handrail 50 has a rear end thereof pivotally connected to an opposing rear end of the base frame 20 for holding by user's both hands.

Figure 3:
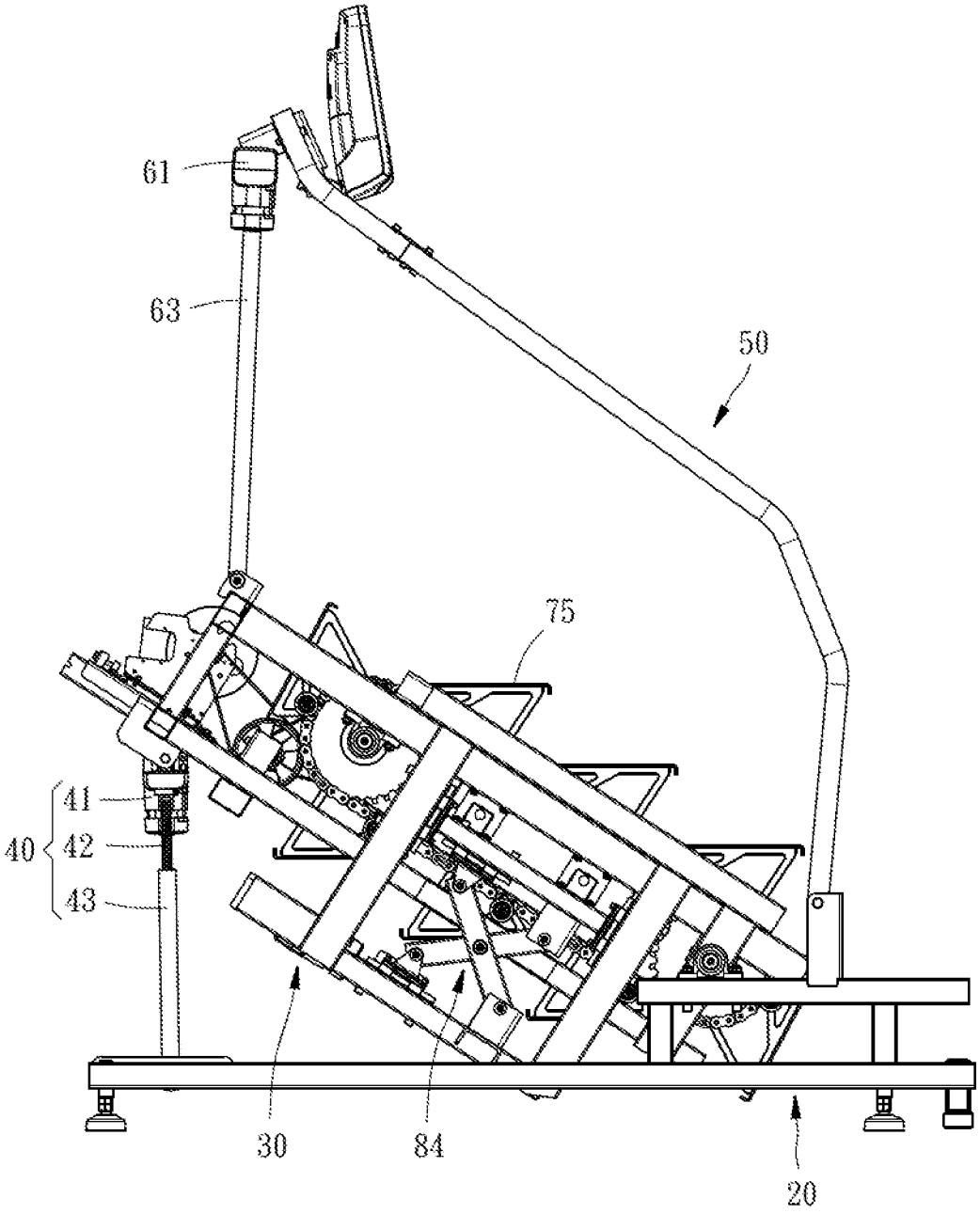
FIG. 3 is a side view of the incline angle adjustable stair climbing machine in accordance with the present invention.
Figure 9:
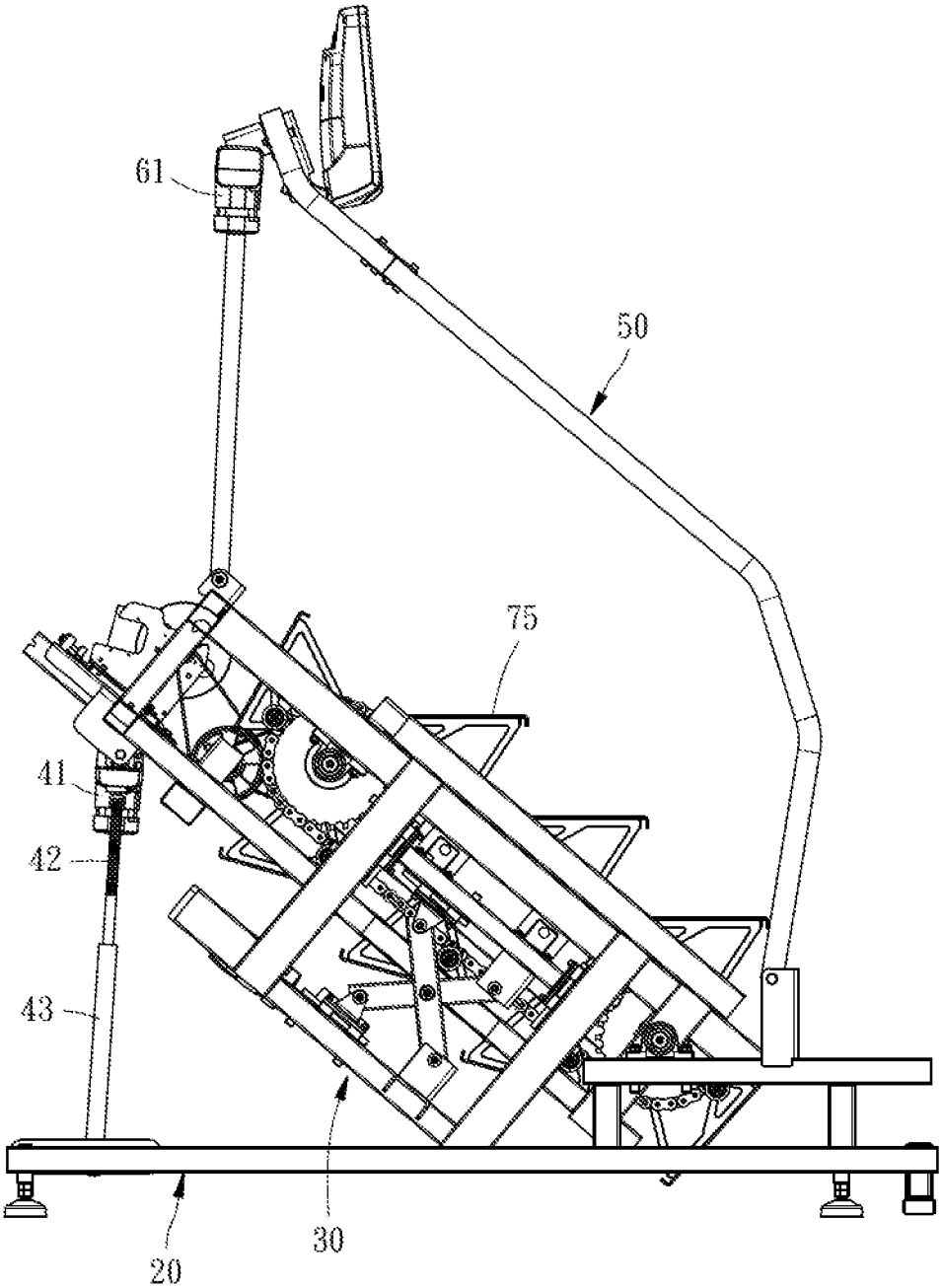
FIG. 9 is similar to FIG. 3, illustrating the incline angle of the stair climbing machine adjusted.

The handrail adjuster 60 comprises a second motor 61, a second screw rod 62, and a second sleeve 63. The second motor 61 is pivotally connected to an opposing front end of the handrail 50. The second screw rod 62 has a top end thereof connected to the second motor 61. The second sleeve 63 is threaded onto the second screw rod 62 with a bottom end thereof pivotally connected to the front end of the tilting seat 30. Thus, as shown in FIG. 3 and FIG. 9, when the second motor 61 is started to rotate the second screw rod 62 clockwise or counter-clockwise, the second screw rod 61 causes the second motor 61 to move axially upward or downward along the second screw rod 62, thereby turning the handrail 50 upward or downward relative to the tilting seat 30.

Figure 7:
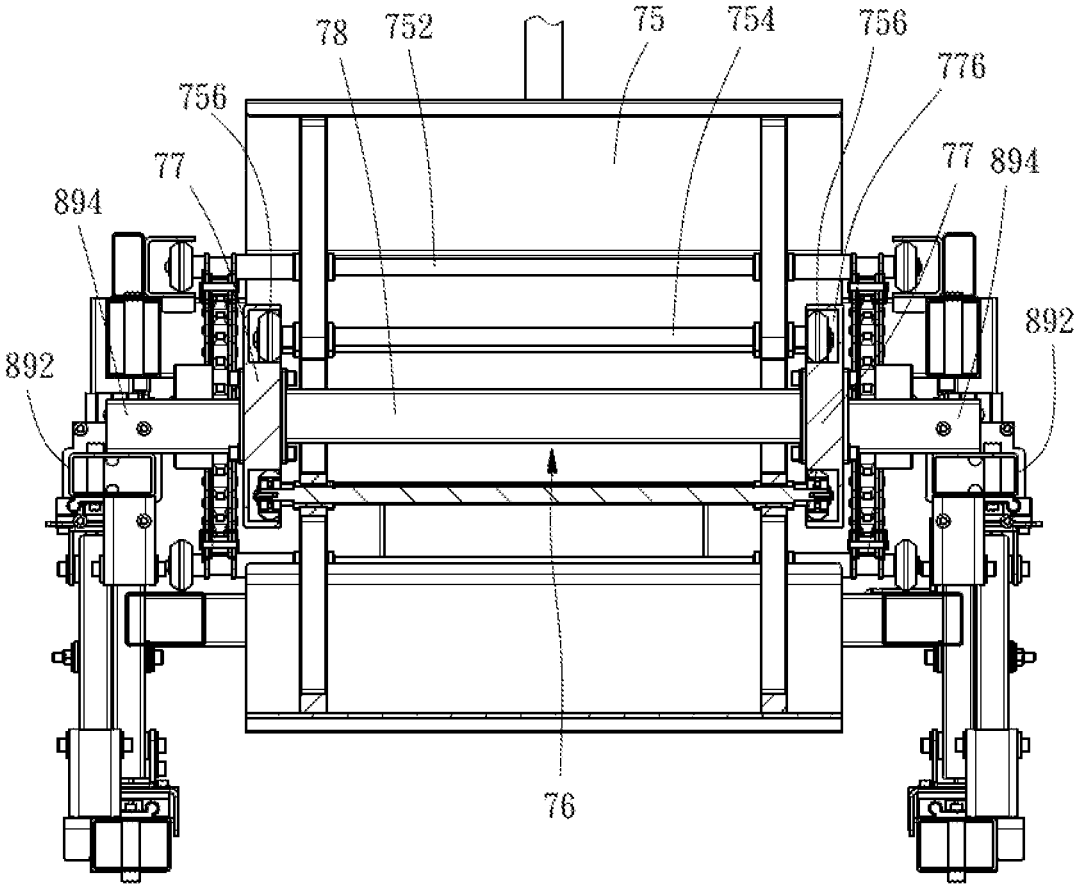
FIG. 7 is a partial sectional view of the present invention, illustrating the structural relationship between the tread board, the tread board adjustment frame and the bracket.

The staircase 70 comprises two opposing front chain wheels 72, two opposing rear chain wheels 73, two chains 74, and a plurality of tread boards 75 that are arranged in a front-rear parallel manner. The two front chain wheels 72 are mounted at the front end of the tilting seat 30 in opposing left and right positions with a front wheel axle 722. The two rear chain wheels 73 are mounted at the rear end of the tilting seat 30 in opposing left and right positions with a rear wheel axle 732. Each chain 74 is mounted around one respective front chain wheel 72 and one respective rear chain wheel 73 at one same side, enabling the respective chain wheels 72,73 to be rotated synchronously. Each tread board 75 is pivotally connected between the two chains 74 with a respective tread board axle 752 so that each tread board 75 can be carried by the chains 74 to cycle, and can also be biased up and down relative to the tilting seat 30. The staircase 70 further comprises a tread board adjustment frame 76 (see FIG. 7). The tread board adjustment frame 76 comprises two opposing side plates 77, and two support rods 78 connected between the two side plates 77. Each side plate 77 has an elongated slot 772 (see FIG. 2) located near a front end thereof for the passing of the front wheel axle 722, and a rectangular hole 774 (see FIG. 1) located near an opposing rear end thereof for the passing of the rear wheel axle 732. The elongated slot 772 is larger than the outer diameter of the front wheel axle 722. The rectangular hole 774 is larger than the outer diameter of the rear wheel axle 732. Thus, when the side plates 77 are driven by an external force, they can be moved alternatively up and down relative to the tilting seat 30. As shown in FIG. 7, each side plate 77 further has a guide groove 776 located at an inner wall thereof. Each tread board 75 is coupled between the guide grooves 776 of the two side plates 77 by a guide rod 754. The guide rod 754 has two opposite ends thereof respectively mounted with a guide roller 756 that is rotatably coupled to the guide groove 776 of one respective side plate 77 to enhance tread board moving stability, allowing the respective tread board 75 to be moved synchronously with the tread board adjustment frame 76.

Figure 6:
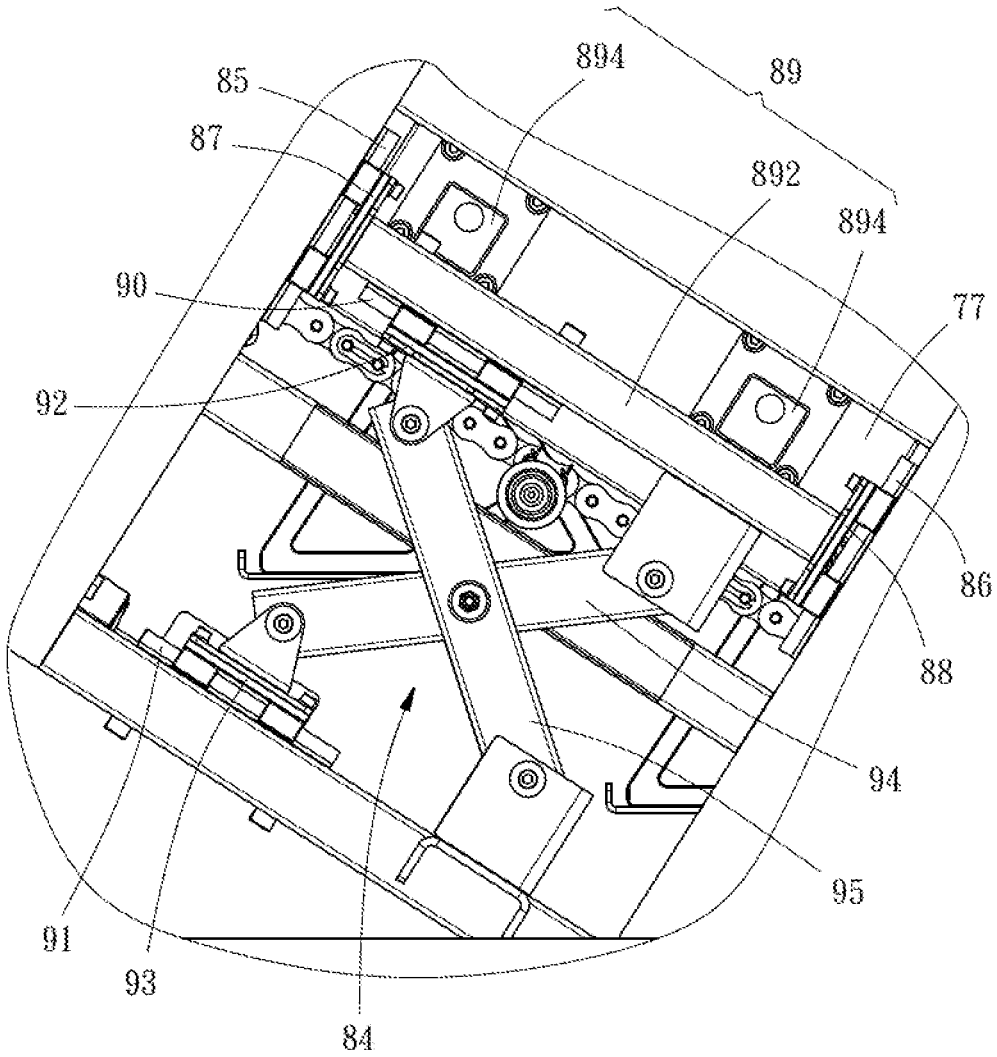
FIG. 6 is an enlarged view of a part of the linkage of the incline angle adjustable stair climbing machine in accordance with the present invention.
Figure 8:
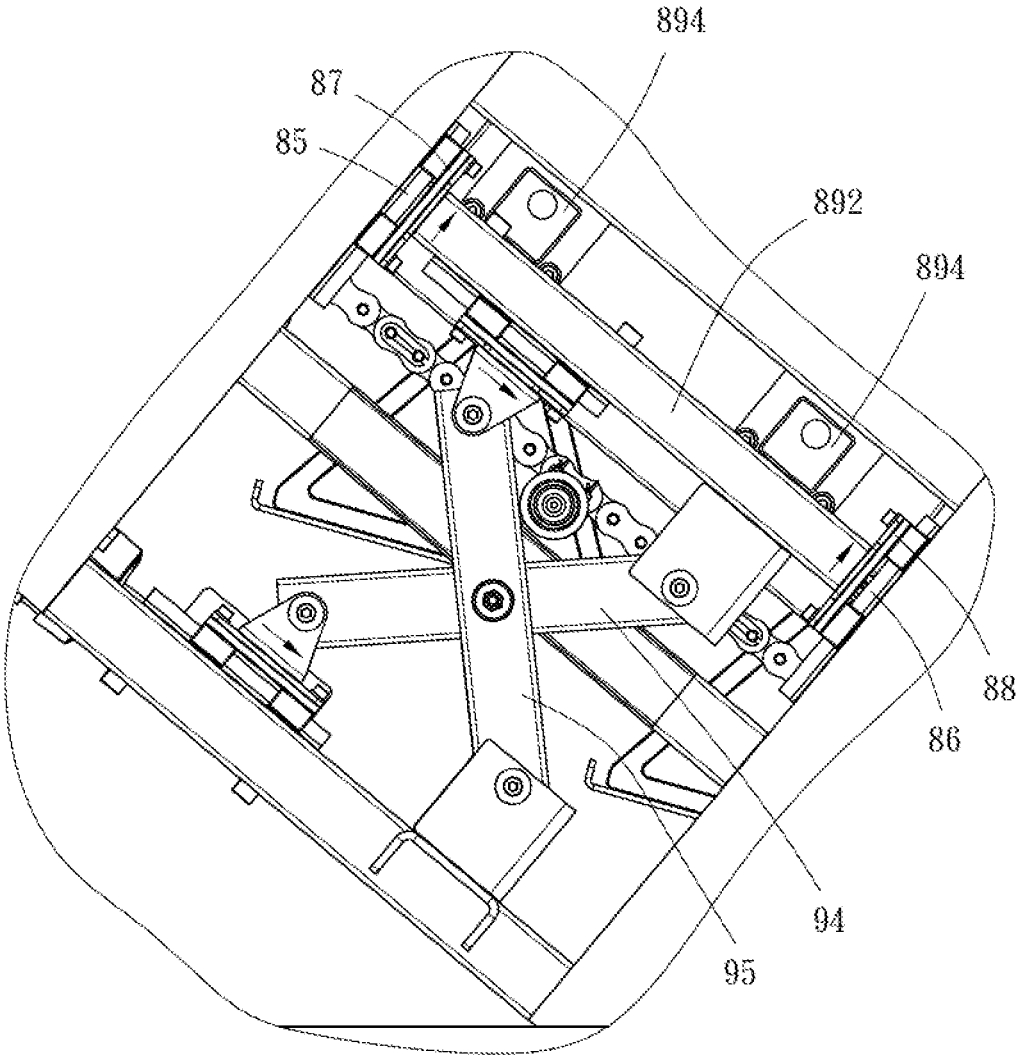
FIG. 8 is similar to FIG. 6, illustrating the linkages operated and the tread boards lifted.

Referring to FIGS. 4-8, the tread board adjuster 80 comprises a third motor 81, a third screw rod 82, a third sleeve 79, and an interlocking seat 83. The third motor 81 is mounted at the tilting seat 30. The third screw rod 82 has a front end thereof connected to the third motor 81. The third sleeve 79 is threaded onto the third screw rod 82 with a bottom end thereof affixed to the interlocking seat 83. Thus, when the third motor 81 is started to rotate the third screw rod 82 clockwise or counter-clockwise, the third sleeve 79 is caused by the third screw rod 82 to carry the interlocking seat 83 axially forwards or backwards along the third screw rod 82. The tread board adjuster 80 further comprises two opposing linkages 84. As illustrated in FIG. 4, FIG. 6 and FIG. 8, each linkage 84 comprises a front sliding rail 85, a rear sliding rail 86, a front sliding seat 87, a rear sliding seat 88, a bracket 89, an upper sliding rail 90, a lower sliding rail 91, an upper sliding seat 92, a lower sliding seat 93, a first link 94, and a second link 95. The front sliding rail 85 is affixed to the tilting seat 30. The rear sliding rail 86 is affixed to the tilting seat 30 opposite to the front sliding rail 85. The front sliding seat 87 and the rear sliding seat 88 are respectively mounted on the front sliding rail 85 and the rear sliding rail 86. The bracket 89 comprises a first prop rod 892, and two second prop rods 894 arranged in parallel. The first prop rod 892 has opposing front and rear ends thereof respectively connected to the front sliding seat 87 and the rear sliding seat 88. The second prop rods 894 have respective opposing front and rear ends thereof respectively connected to respective outer walls of the side plates 77 of the tread board adjustment frame 76 and the first prop rod 892. The upper sliding rail 90 is affixed to a bottom side of the first prop rod 892 of the bracket 89 between the front sliding rail 85 and the rear sliding rail 86. The lower sliding rail 91 is affixed to the tilting seat 30 to face toward the upper sliding rail 90. The upper sliding seat 92 and the lower sliding seat 93 are respectively mounted at the upper sliding rail 90 and the lower sliding rail 91. Further, the lower sliding seat 93 is connected to one end of the interlocking seat 83 (see FIG. 4). Thus, the lower sliding seat 93 can be carried to move by the interlocking seat 83. The first link 94 has opposing top and bottom ends thereof respectively pivotally connected to the first prop rod 892 of the bracket 89 and the lower sliding seat 93. The second link 95 has opposing top and bottom ends thereof respectively pivotally connected to the upper sliding seat 92 and the tilting seat 30. Further, the first link 94 and the second link 95 are pivotally connected together in a crossed manner.

Based on the above-described structural composition, if the user wishes to adjust the climb gradient, start up the first motor 41 to rotate the first screw rod 42, thereby biasing the tilting seat 30 relative to the base frame 20. At this time, subject to angular position change of the tilting seat 30, the climb gradient is relatively changed. After reached the desired angle, turn off the first motor 41 to keep the tilting seat 30 in the adjusted angular position, and the user can thus step on the tread boards 75 to perform stair-climbing exercises on the desired climb gradient.

Because the angular position of the tilting seat 30 can be changed relative to the base frame 20, in order to let the user hold the handrail 50 with the two hands under the ergonomic posture during the process the user is stepping on the tread boards 75, the second motor 61 can be started up to rotate the second screw rod 62 in biasing the handrail 50 relative to the tilting seat 30 to a suitable angular position. After the tilting seat 30 reaches the desired angular position, turn off the second motor 61, keeping the handrail 50 in the optimal angular position suitable for holding by the user's both hands.

On the other hand, the tread boards 75 can be slightly tilted with the change of the tilting seat 30 in the incline angle. In order to let the tread boards 75 to be constantly maintained in horizontal for stepping by the user as the angle of the tilting seat 30 is changed, the third motor 81 can be started up to rotate the third screw rod 82 in moving the lower sliding seat 93 via the interlocking seat 83. When the lower sliding seat 93 is moved, the first link 94 and the second link 95 are biased relative to each other to move the bracket 89 upwards. At this time, the bracket 89 moves the tread board adjustment frame 76 upwards relative to the tilting seat 30 subject to matching between the front sliding seat 87 and the front sliding rail 85 and matching between the rear sliding seat 88 and the rear sliding rail 86. During movement of the tread board adjustment frame 76, the slide plates 77 are forced to bias the tread boards 75 relative to the tilting seat 30, enabling the tread boards 75 to be maintained in horizontal after change of the incline angle of the tilting seat 30, and allowing the user to conduct a stepping exercise with less effort.

In order to let the stair climbing machine 10 to be operated efficiently and conveniently, the tilting seat adjuster 40, the handrail adjuster 60 and the tread board adjuster 80 can be controlled to work synchronously through an electronic control measure so that when changing the incline angle of the tilting seat 30, the tread boards 75 or the handrail 50 can be relatively biased to the optimal angular position suitable for exercise.

In conclusion, the stair climbing machine 10 of the invention uses the tilting seat adjuster 40 to adjust the incline angle of the tilting seat 30 and the tread board adjuster 80 to adjust the horizontal angle of the tread boards 75, enabling the user to conduct stair-climbing exercises at different climb gradients accurately and comfortably. Further, the stair climbing machine 10 uses the handrail adjuster 60 to adjust the incline angle of the handrail 50, or employs an electronic control measure to actuate the tilting seat adjuster 40, the tread board adjuster 80 and the handrail adjuster 60 synchronously, enabling the user to get good support in the operation, and achieving the objects of the present invention.

What is claimed is:

1. An incline angle adjustable stair climbing machine, comprising:

a base frame;

a tilting seat pivotally mounted at said base frame;

a tilting seat adjuster mounted between said base frame and said tilting seat and adapted for adjusting an incline angle of said tilting seat;

a staircase mounted at said tilting seat, said staircase comprising a plurality of tread boards biasable relative to said tilting seat; and a tread board adjuster mounted at said tilting seat and connected with said plurality of tread boards of said staircase and adapted for adjusting an angle of each said tread board relative to said tilting seat to keep each said tread board constantly horizontal;

wherein said staircase further comprises a tread board adjustment frame vertically movably mounted at said tilting seat and connected with each said tread board; said tread board adjuster is mounted between said tilting seat and said tread board adjustment frame;

wherein said tread board adjuster comprises a tread board adjuster motor, a tread board adjuster screw rod, a tread board adjuster sleeve, an interlocking seat and two opposing linkages, said tread board adjuster motor being mounted at said tilting seat, said tread board adjuster screw rod having a front end thereof connected to said tread board adjuster motor, said tread board adjuster sleeve being threaded onto said tread board adjuster screw rod, said interlocking seat being connected to said tread board adjuster sleeve, said two linkages being respectively mounted at two opposite ends of said interlocking seat and connected with said tread board adjustment frame.

2. The incline angle adjustable stair climbing machine as claimed in claim 1, wherein said tilting seat adjuster comprises a tilting seat adjuster motor, a tilting seat adjuster screw rod and a tilting seat adjuster sleeve, said tilting seat adjuster motor being pivotally mounted at a front end of said tilting seat, said tilting seat adjuster screw rod having a top end thereof connected to said tilting seat adjuster motor, said tilting seat adjuster sleeve being thread onto said tilting seat adjuster screw rod with a bottom end thereof affixed to said base frame.

3. The incline angle adjustable stair climbing machine as claimed in claim 1, further comprising a handrail and a handrail adjuster, said handrail having a rear end thereof pivotally connected to a rear end of said base frame, said handrail adjuster being mounted between a front end of said tilting seat and an opposing front end of said handrail and adapted for adjusting an incline angle of said handrail.

4. The incline angle adjustable stair climbing machine as claimed in claim 3, wherein said handrail adjuster comprises a handrail adjuster motor, a handrail adjuster screw rod and a handrail adjuster sleeve, said handrail adjuster motor is pivotally mounted at the front end of said handrail, said handrail adjuster screw rod having a top end thereof connected to said handrail adjuster motor, said handrail adjuster sleeve being threaded onto said handrail adjuster screw rod with a bottom end thereof affixed to the front end of said tilting seat.

5. The incline angle adjustable stair climbing machine as claimed in claim 1, wherein said staircase comprises two opposing front chain wheels, two opposing rear chain wheels and two chains, said front chain wheels and said rear chain wheels being respectively and rotatably mounted at opposing left and right sides of said tilting seat, said two chains being respectively mounted around one respective said front chain wheel and one respective said rear chain wheel; each said tread board is pivotally connected between said two chains with a respective tread board axle.

6. The incline angle adjustable stair climbing machine as claimed in claim 1, wherein each said linkage of said tread board adjuster comprises a front sliding rail, a rear sliding rail, a front sliding seat, a rear sliding seat, a bracket, an upper sliding rail, a lower sliding rail, an upper sliding seat, a lower sliding seat, a first link and a second link, said front sliding rail being affixed to said tilting seat, said rear sliding rail being affixed to said tilting seat opposite to said front sliding rail, said front sliding seat and said rear sliding seat being respectively mounted at said front sliding rail and said rear sliding rail, said bracket connecting said front sliding seat, said rear sliding seat and said tread board adjustment frame, said upper sliding rail being affixed to said bracket between said front sliding rail and said rear sliding rail, said lower sliding rail being affixed to said tilting seat opposite to said upper sliding rail, said upper sliding seat and said lower sliding seat being respectively mounted at said upper sliding rail and said lower sliding rail, said first link having opposing top and bottom ends thereof respectively pivotally connected to said bracket and said lower sliding seat, said second link having opposing top and bottom ends thereof respectively pivotally connected to said upper sliding seat and said tilting seat, said first link and said second link being pivotally connected together in a crossed manner, said two opposite ends of said interlocking seat respectively connected to the lower sliding seats of said two linkages of said tread board adjuster.

7. The incline angle adjustable stair climbing machine as claimed in claim 6, wherein said tread board adjustment frame comprises two opposing side plates, each said side plate having an outer wall thereof connected to said bracket and an opposing inner wall thereof provided with a guide groove; said staircase comprises a plurality of guide rods and a plurality of guide rollers, each said guide rod being connected with one respective said tread board, said plurality of guide rollers being respectively mounted at opposing ends of said plurality of guide rods and respectively rotatably coupled to said guide grooves of said side plates.

8. The incline angle adjustable stair climbing machine as claimed in claim 7, wherein said staircase further comprises a front wheel axle and a rear wheel axle, said front wheel axle connecting said two front chain wheels, said rear wheel axle connecting said two rear chain wheels; each said side plate defining a front axle hole and a rear axle hole for the passing of said front wheel axle and said rear wheel axle respectively, said front axle hole and said rear axle hole being larger than the outer diameter of said front wheel axle and said rear wheel axle.

* * * * *